US009702606B2

(12) United States Patent
Chen

(10) Patent No.: US 9,702,606 B2
(45) Date of Patent: Jul. 11, 2017

(54) PRESSURE OPERATION CONTROL MODULE OF COOLANT RECOVERY DEVICE

(71) Applicant: BOUNDLESS LIN CO., LTD., New Taipei (TW)

(72) Inventor: Chiang-Kao Chen, New Taipei (TW)

(73) Assignee: Boundless Lin Co., Ltd., New Taipei (TW)

( * ) Notice: Subject to any disclaimer, the term of this patent is extended or adjusted under 35 U.S.C. 154(b) by 168 days.

(21) Appl. No.: 14/882,751

(22) Filed: Oct. 14, 2015

(65) Prior Publication Data

US 2017/0108257 A1 Apr. 20, 2017

(51) Int. Cl.
*F25B 49/02* (2006.01)
*F25B 45/00* (2006.01)
*F25B 1/02* (2006.01)

(52) U.S. Cl.
CPC ..... *F25B 49/022* (2013.01); *F25B 1/02* (2013.01); *F25B 45/00* (2013.01); *F25B 2400/06* (2013.01); *F25B 2400/075* (2013.01); *F25B 2400/077* (2013.01)

(58) Field of Classification Search
CPC ..... F25B 1/00; F25B 45/00; F25B 49/022; F25B 2345/00; F25B 2345/001; F25B 2345/002; F25B 2345/003; F25B 2400/06; F25B 2400/075; F25B 2400/077
USPC ..... 62/149, 292
See application file for complete search history.

(56) References Cited

U.S. PATENT DOCUMENTS 7,878,081 B2 2/2011 Sundheim
2011/0120242 A1 5/2011 Sundheim
2016/0187039 A1* 6/2016 Higami ..... F25B 45/00 62/292

FOREIGN PATENT DOCUMENTS

TW M380467 5/2010
TW DE 202015105609 U1 * 5/2016 ..... F25B 45/00

* cited by examiner

*Primary Examiner* — Marc Norman
(74) *Attorney, Agent, or Firm* — Rosenberg, Klein & Lee

(57) ABSTRACT

A pressure operation control module is provided for a coolant recovery device and includes a gas path flow division module, two pressure-variable cylinders, a motor, and at least one the control circuit. The gas path flow division module has high-pressure and low-pressure coolant terminals respectively coupled to high-pressure and low-pressure electromagnetic valves and high-pressure and low-pressure sensors for providing connection control and pressure detection of the high-pressure and low-pressure terminals for coolant recovery. The variable-pressure cylinders each have an output terminal connected to an input terminal of the gas path flow division module. The pressure-variable cylinder includes at least one piston/connection rod assembly including a connection portion and a joint portion. The piston/connection rod assembly maintains a linear movement in the pressure-variable cylinder for all angles. The motor is connected to an end of the piston/connection rod assembly of the pressure-variable cylinder to drive the piston/connection rod assembly to linearly move. The control circuit is electrically connected to and controls the opening/closing of the high-pressure and low-pressure electromagnetic valves of the gas path flow division module and the operation of the motor.

18 Claims, 11 Drawing Sheets

PRESSURE OPERATION CONTROL MODULE OF COOLANT RECOVERY DEVICE

BACKGROUND OF THE INVENTION

1. Field of the Invention

The present invention relates to a pressure operation control module of a coolant recovery device, and in particular to one that uses a pair of high-pressure side and low-pressure side electromagnetic valves and a control circuit to control the operation of high and low pressure of a coolant recovery device and the operation of a motor.

2. The Related Arts

Coolant recovery devices have been widely used to applications of retrieving and collecting used coolant from coolant-operating machines, such as air-conditioners and refrigerators. A conventional coolant recovery device generally comprises a high-pressure connection terminal and a lower-pressure connection terminal selectively connected to a coolant-recovery machine and a storage tank in order to retrieve the used coolant from the coolant-recovery machine and store it in the storage tank. The conventional coolant recovery device is provided with a single pressure switch to control the activation and deactivation of a motor-based power source arranged inside the coolant recovery device. Such a pressure switch is incapable of identifying the pressure level of the high-pressure connection terminal or the low-pressure connection terminal and is operated through setting made on the basis of the coolant pressure in controlling the activation and deactivation of the motor-based power source of the coolant recovery device. This prevents the timing of activation and deactivation of the coolant recovery device from suiting the need for high precision operations. Further, the high-pressure connection terminal and the low-pressure connection terminal of the conventional coolant recovery device must be operated manually for rotating switch valves to open or close the high-pressure connection terminal and the low-pressure connection terminal of the coolant recovery device. This would cause inconvenience of operation for an operator. Further, opening and closing the opening switches are manually operated by an operator who visually observe pressure gauge reading of the high-pressure connection terminal and the low-pressure connection terminal of the coolant recovery device and also relying on the experience thereof in order to control the opening and closing of the high-pressure connection terminal and the low-pressure connection terminal of the coolant recovery device, making it hard to control the sequence and timing of opening or closing in a precise manner and readily leading to a poor efficiency of coolant recovery. Further, residue of coolant may be accumulated in pipes and leakage of coolant may be present. These are issues of conventional coolant recovery devices to be addressed.

Further, a conventional coolant recovery device comprises a press-variable cylinder in which a motor drives a piston/connection rod assembly to reciprocally move in the pressure-variable cylinder. However, such a movement cannot be kept in a condition of moving in a linear manner along a central axis and would lead to wearing between a piston head of the piston/connection rod assembly and an inner surface of the pressure-variable cylinder, eventually making it not possible to maintain air tightness between the pressure-variable cylinder and the piston/connection rod assembly and thus resulting in leakage. To cope with such a problem, the output power of the motor must be increased in order to compensate the loss caused by leakage, leading to an increase of power consumption of the entire device. This is generally not economic. Further, the rating power of the driving motor C must be increased and this leads to an increase of installation cost of the coolant recovery device, making it also not economic.

Prior art documents are known in this field. For example, Taiwan Utility Model M380467 discloses an electronic measurement device for a coolant recovery machine, in which an electronic measurement device and a pressure sensor are used to control the activation and deactivation of the coolant recovery machine. Although the issue of imprecise timing of activation and deactivation of the above-described coolant recovery device involving a single pressure switch can be alleviated, the high-pressure connection terminal and low-pressure connection terminal (namely the input pipe 111 and the output pipe 112) of the coolant recovery machine of this prior art document are structured such that manual operation of rotating a switch (14) (as shown in FIG. 1 of the prior art document) is necessary for controlling the opening or closing of the high-pressure connection terminal and the low-pressure connection terminal. There is still the same problem that it is hard to control the sequence and timing of opening or closing of the high-pressure connection terminal and the low-pressure connection terminal of the conventional coolant recovery machine and eventually leading to poor operation efficiency of the coolant recovery machine and problems of residue and leakage of coolant accumulated in pipes.

In addition, US patent publication No. 2011/0120242 discloses a portable refrigerant recovery unit and U.S. Pat. No. 7,878,081 discloses a portable refrigerant recovery unit. Both disclose the typical coolant recovery devices as those conventional ones discussed above and also suffer the same drawbacks and problems of imprecise operation of activation and deactivation of the coolant recovery devices controlled by using a single pressure switch and also the drawbacks and problems of being hard to precisely control sequence and timing of opening or closing a high-pressure connection terminal and a low-pressure connection terminal of the coolant recovery device and thus poor operation efficiency of the coolant recovery device and residue and leakage of coolant accumulated in pipes.

SUMMARY OF THE INVENTION

The known and prior art coolant recovery devices involve a motor controllable for activation and deactivation by a single pressure switch that detects pressures and shuts down the operation of the motor of the coolant recovery device so that the timing of opening or closing of the coolant recovery device may not meet the requirement for precise operations and the coolant recovery device comprises a high-pressure connection terminal and a low-pressure connection terminal that are structured such that the opening or closing of the high-pressure connection terminal and the low-pressure connection terminal of the coolant recovery device can only be conducted through manual operation of rotating switch valves by an operator visually observing indicators of pressure gauges and based on the experience thereof, making it hard to control sequence and timing of opening and closing and readily leading to the problems and drawbacks that the recovery efficiency of coolant is poor and residue and leakage of coolant accumulated in pipes. Further, the coolant recovery device involves a pressure-variable cylinder in which a piston/connection rod assembly is moved but such a movement cannot be maintained linear along a central axis, leading to wearing of the piston/connection rod assembly and eventually leakage occurring in the pressure-variable cylinder that in turn leads to the need of increasing the motor power of the coolant recovery device and an increase of power consumption.

Thus, the present invention provides a pressure operation control module of a coolant recovery device, which comprises:

a gas path flow division module, which has a high-pressure connection terminal, a low-pressure connection terminal, and two pairs of output port and input port, the high-pressure connection terminal being connected to the output ports, the low-pressure connection terminal being connected to the input ports in order to provide a function of gas path flow division for collecting coolant from a recovery machine through the coolant recovery device to a storage tank, the coolant high-pressure connection terminal and the coolant low-pressure connection terminal being respectively provided with a high-pressure electromagnetic valve, a low-pressure electromagnetic valve, a high-pressure sensor, and a low-pressure sensor for providing coolant connection control and pressure detection of the high-pressure connection terminal and the low-pressure connection terminal for coolant recovery, the two output ports of the gas path flow division module being respectively connected to input terminals of two heat exchangers arranged in the coolant recovery device;

two pressure-variable cylinders each comprising an input terminal and an output terminal, the output terminals being respectively connected to the two input ports of the gas path flow division module, the input terminals of the pressure-variable cylinders being respectively connected to output terminals of the two heat exchangers to which the gas path flow division module is connected in order to receive coolant from the heat exchangers, the pressure-variable cylinders each comprising a piston/connection rod assembly, the piston/connection rod assembly having an end received in an internal cylinder surface of the pressure-variable cylinder so that a reciprocal movement of the piston/connection rod assembly varies coolant pressure inside the pressure-variable cylinder, which is then supplied through the output terminal of the pressure-variable cylinder to the input port of the gas path flow division module;

a motor, which comprises a rotary shaft coupled to an end of the piston/connection rod assembly of each of the pressure-variable cylinders to drive the piston/connection rod assembly to do linear reciprocal movement in the pressure-variable cylinder; and at least one control circuit that is electrically connected to the high-pressure side electromagnetic valve, the low-pressure side electromagnetic valve, the high-pressure side pressure sensor, and the low-pressure side pressure sensor of the gas path flow division module in order to control the opening and closing of the high-pressure side electromagnetic valve, the low-pressure side electromagnetic valve that are coupled to the gas path flow division module and activation and de-activation of the motor according to the pressure values detected by the high-pressure side pressure sensor and the low-pressure side pressure sensor.

Further, in the above pressure operation control module of the coolant recovery device, the high-pressure side electromagnetic valve and the low-pressure side electromagnetic valve of the gas path flow division module are anti-explosion electromagnetic valves.

In the above pressure operation control module of the coolant recovery device of the present invention, the piston/connection rod assembly of each of the pressure-variable cylinders comprises:

a connection rod, which has two ends respectively forming at least one connection portion and a joint portion, the connection portion being connected between a plurality of cams connected in a cascade form and a bearing, one of the cams being connected to the rotary shaft of the motor to provide rotating power to the connection portion of the connection rod, the joint portion comprising a bearing, an elastic washer, a washer, and a groove-mounting closure ring;

a piston head, which has an end on which two lugs are mounted, the lugs being respectively set at two opposite sides of the joint portion of the connection rod;

an axle, which extends through the two lugs of the piston head and the bearing, the elastic washer, the washer, and the groove-mounting closure ring of the joint portion of the connection rod; and two axle fastening rings, which are respectively fixed to two ends of the axle to form a pivotal connection structure between the joint portion of the connection rod and the lugs of the piston head that allows for relative rotation therebetween so that when the piston head is disposed in and moves in the pressure-variable cylinder, a linear motion is achieved that keeps a gap-free tight engagement with an inside surface of the pressure-variable cylinder.

In the above pressure operation control module of the coolant recovery device, the connection portion of the connection rod of the piston/connection rod assembly of each of the pressure-variable cylinders comprises a hole formed therein. The hole receives a bearing mounted therein to couple to a rotary shaft of the motor.

In the above pressure operation control module of the coolant recovery device, the joint portion of the connection rod of the piston/connection rod assembly of each of the pressure-variable cylinders comprises a slot formed therein for receiving the bearing, the elastic washer, the washer, and the groove-mounting closure ring mounted therein.

In the above pressure operation control module of the coolant recovery device, the joint portion of the connection rod of the piston/connection rod assembly of each of the pressure-variable cylinders comprises a circumferential groove formed at one side of the slot to the groove-mounting closure ring fit therein.

In the above pressure operation control module of the coolant recovery device, the lugs of the piston head of the piston/connection rod assembly of the pressure-variable cylinders are each provided with a hole formed therein for extension of the axle.

In the above pressure operation control module of the coolant recovery device, the axle of the piston/connection rod assembly of the pressure-variable cylinders has two ends forming recessed grooves for receiving the axle fastening rings to fit therein.

In the above pressure operation control module of the coolant recovery device, the axle fastening rings of the piston/connection rod assembly of the pressure-variable cylinders are C-clips.

In the above pressure operation control module of the coolant recovery device, the control circuit comprises:

a microprocessor, which provides functions of reading of high and low coolant pressures and temperature, displaying, alarming, and outputs of opening/closing control signals for the high-pressure side electromagnetic valve and the low-pressure side electromagnetic valve and activation/de-activation control signals for the motor;

two analog-to-digital converters, which are respectively and electrically connected to the high-pressure side pressure sensor and the low-pressure side pressure sensor of the gas path flow division module and the microprocessor to convert pressure detection signals of the high-pressure side pressure sensor and the low-pressure side pressure sensor into digital data applied to the microprocessor;

a temperature sensor, which is electrically connected to the microprocessor to detect the temperature of the coolant flowing in the gas path flow division module and generate a corresponding temperature signal to the microprocessor;

at least one memory, which is connected to the microprocessor and stores therein pressure data of various models and types of coolant recovery device and data for the opening/closing time of the high-pressure side electromagnetic valve and the low-pressure side electromagnetic valve of the gas path flow division module and the activation/de-activation control of the motor for coolant recovery operations that are supplied to the microprocessor as a reference for opening/closing the high-pressure side electromagnetic valve and the low-pressure side electromagnetic valve and activation/de-activation of the motor;

a pushbutton assembly, which is electrically connected to the microprocessor for manual operation to set the opening/closing time of the high-pressure side electromagnetic valve and the low-pressure side electromagnetic valve of the gas path flow division module and the control of activation/de-activation of the motor of a coolant recovery operation, displaying and storing operations and control instructions to the microprocessor;

a display interface and a display device, the display interface being connected to the microprocessor and the display device so that the microprocessor drives the display interface to have the display device display the opening/closing time of the high-pressure side electromagnetic valve and the low-pressure side electromagnetic valve of the gas path flow division module and the control of activation/de-activation of the motor of the coolant recovery operation and status and information regarding setting, displaying, storing, control, or alarm;

an alarm device, which is connected to the microprocessor to be controlled by the microprocessor to issue an alarm;

a motor controller, which is connected to the microprocessor and the motor so that the microprocessor controls activation or deactivation of the motor;

a driving circuit, which is connected to the microprocessor and the high-pressure side electromagnetic valve and the low-pressure side electromagnetic valve of the gas path flow division module so as to be driven by the microprocessor to control the opening and closing of the high-pressure side electromagnetic valve and the low-pressure side electromagnetic valve; and a power supply circuit, which supplies direct current power to the microprocessor, the analog-to-digital converters, the temperature sensor, the memory, the pushbutton assembly, the display interface, the display device, the alarm device, the motor controller, and the driving circuit.

In the above pressure operation control module of the coolant recovery device, the microprocessor is connected to a reset circuit to generate an alarm reset signal to the microprocessor for alarm resetting so as to have the alarm device return to a condition of being not activated.

In the above pressure operation control module of the coolant recovery device, the microprocessor is connected to a communication interface circuit and the communication interface circuit is connected to an electronic device.

In the above pressure operation control module of the coolant recovery device, the communication interface circuit to which the microprocessor is connected comprises a universal serial bus (USB) interface circuit.

In the above pressure operation control module of the coolant recovery device, the microprocessor is connected to a wireless data transmission circuit to receive or transmit, in a wireless manner, pressure data for coolant recovery and data and status of the opening/closing time of the high-pressure side electromagnetic valve and the low-pressure side electromagnetic valve and the control of activation/de-activation of the motor of the coolant recovery operation of the coolant recovery operation.

In the above pressure operation control module of the coolant recovery device, the wireless data transmission circuit to which the microprocessor is connected comprises a Bluetooth transmission circuit.

In the above pressure operation control module of the coolant recovery device, the wireless data transmission circuit to which the microprocessor is connected comprises a wireless USB transmission circuit.

In the above pressure operation control module of the coolant recovery device, wherein the display device comprises a liquid crystal display device.

In the above pressure operation control module of the coolant recovery device, the alarm device comprises an audio/video alarm device.

The efficacy of the pressure operation control module of the coolant recovery device according to the present invention is that the connection portion and the joint portion of the connection rod of the piston/connection rod assembly of the pressure-variable cylinder are structured to provide a linear movement of the piston/connection rod assembly within the internal cylinder surface of the pressure-variable cylinder along a central axis in a manner of being kept in tight engagement in order to ensure the internal pressure of the pressure-variable cylinder is prevented from leaking and the piston head of the piston/connection rod assembly is not get worn. Further, the control circuit controls the high-pressure side electromagnetic valve and the low-pressure side electromagnetic valve to respectively open or close the high-pressure and low-pressure connection terminals of the gas path flow division module and controls the activation and deactivation of the motor of the coolant recovery device so as to achieve, in a precise and efficient manner, opening and closing of the high-pressure and low-pressure connection terminals of the coolant recovery device and the operation of the motor, enabling completely control of the timing of the opening/closing of the high-pressure and low-pressure connection terminal of the coolant recovery device and the operation of the motor without the need of using a single pressure switch and manual rotation for switching. Further, wired or wireless manners may be used to efficiently transmit the operation information of the coolant recovery device to a remote control center or an electronic device of a monitoring operator for monitoring and recording and may also allow for data sharing and storage among multiple coolant recovery devices having the control circuit without the need of an operator re-entering and establishing the data. Also, the data can be timely updated through wired or wireless transmission to further improve the operation of the coolant recovery device of the present invention and capability of data exchange thereof.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
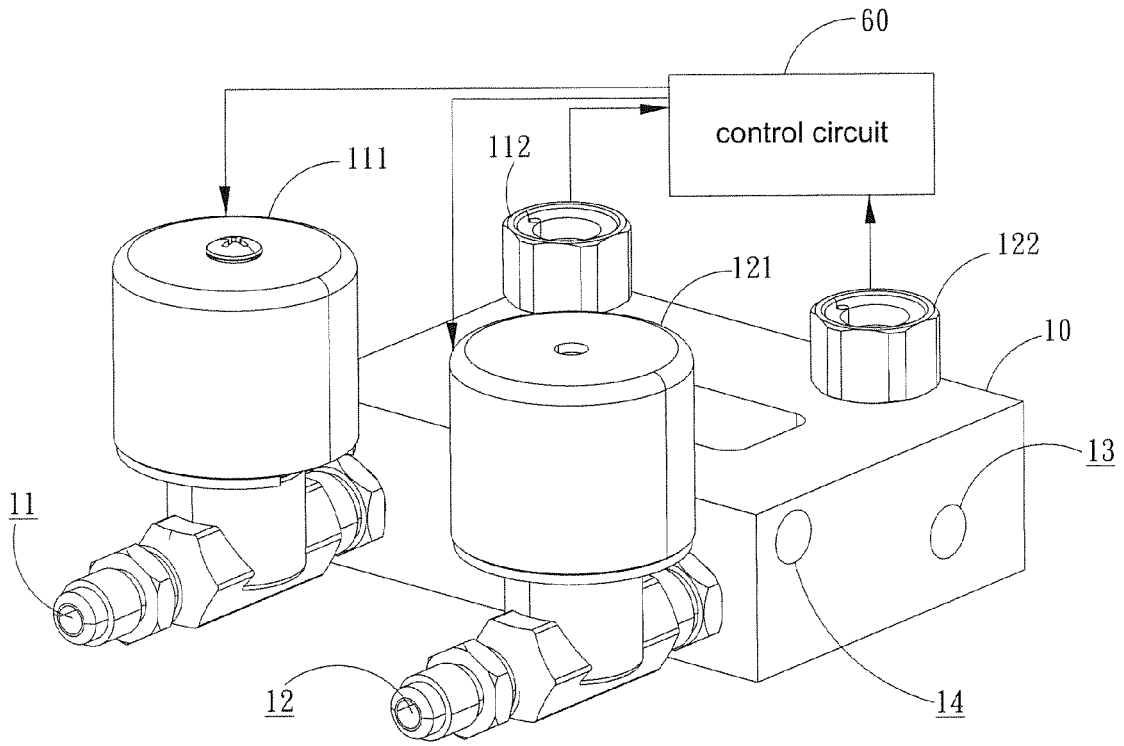
FIG. 1 is a perspective view showing a pressure operation control module of a coolant recovery device according to the present invention.
Figure 2:
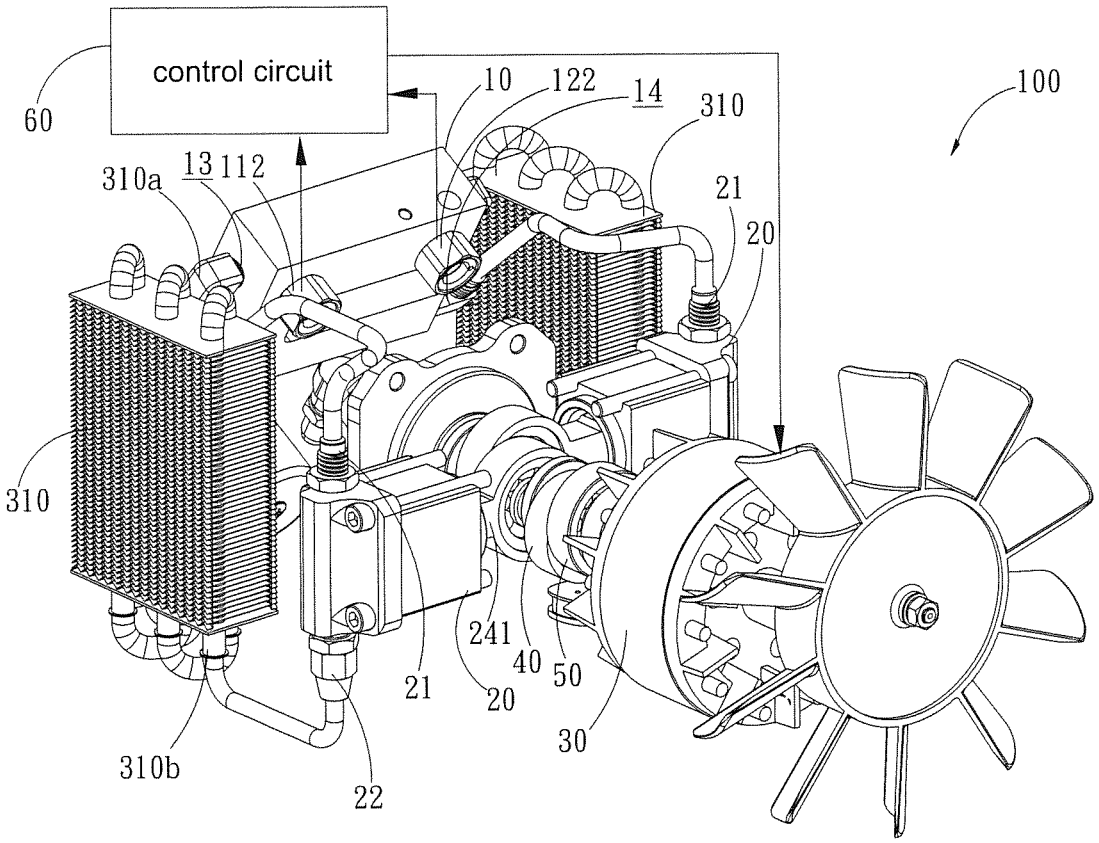
FIG. 2 is a perspective view illustrating the connection among the pressure operation control module of the coolant recovery device according to the present invention and pressure-variable cylinders, heat exchangers, and a motor of the coolant recovery device.

Referring to FIGS. 1 and 2, the present invention provides a pressure operation control module 100 of a coolant recovery device. The pressure operation control module comprises a gas path flow division module 10, which has a high-pressure connection terminal 11, a low-pressure connection terminal 12, and two pairs of output port 13 and input port 14. The high-pressure connection terminal 11 is connected to the output ports 13. The low-pressure connection terminal 12 is connected to the input ports 14. The high-pressure connection terminal 11 and the low-pressure connection terminal 12 of the gas path flow division module 10 are respectively connected to a high-pressure side electromagnetic valve 111, a high-pressure side pressure sensor 112 and a low-pressure side electromagnetic valve 121, a low-pressure side pressure sensor 122 to respectively control opening and closing of the high-pressure connection terminal 11 and the low-pressure connection terminal 12 and to detect coolant pressures at the high-pressure connection terminal 11 and the low-pressure connection terminal 12. The high-pressure side electromagnetic valve 111 and the low-pressure side electromagnetic valve 121 are not limited to any specific form and an anti-explosion electromagnetic valve is taken as an example in the present invention.

The output ports 13 of the gas path flow division module 10 are connected to input terminals 310*a* of two heat exchangers 310 arranged in a coolant recovery device 300 (as shown in FIG. 2).

Figure 10:
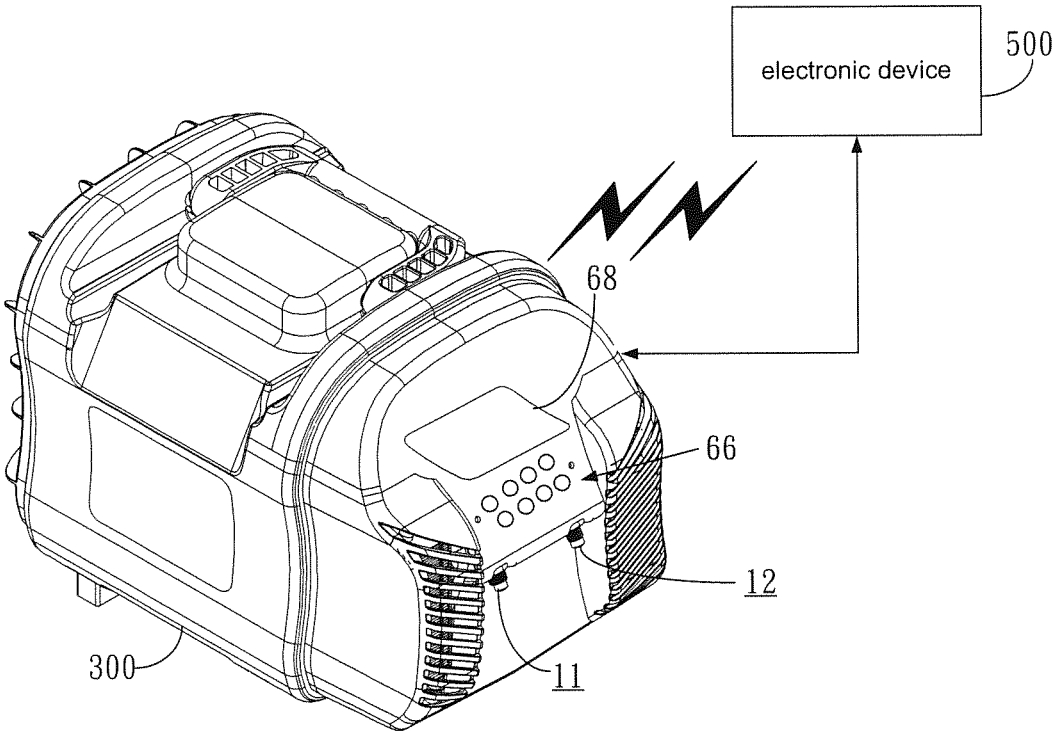
FIG. 10 is a perspective view illustrating an example of the pressure operation control module of the coolant recovery device according to the present invention.

At least two pressure-variable cylinders 20 each comprise an output terminal 21 and an input terminal 22. The output terminals 21 are respectively connected to the two input ports 14 of the gas path flow division module 10. The input terminals 22 are respectively connected to output terminals 310*b* of the two heat exchangers 310 arranged in the coolant recovery device 300 (as shown in FIG. 10) so that the gas path flow division module 10 provides a function of gas path flow division for collecting coolant from a recovery machine 200 (as shown in FIG. 10) through the coolant recovery device 300 to a storage tank 400.

Figure 3:
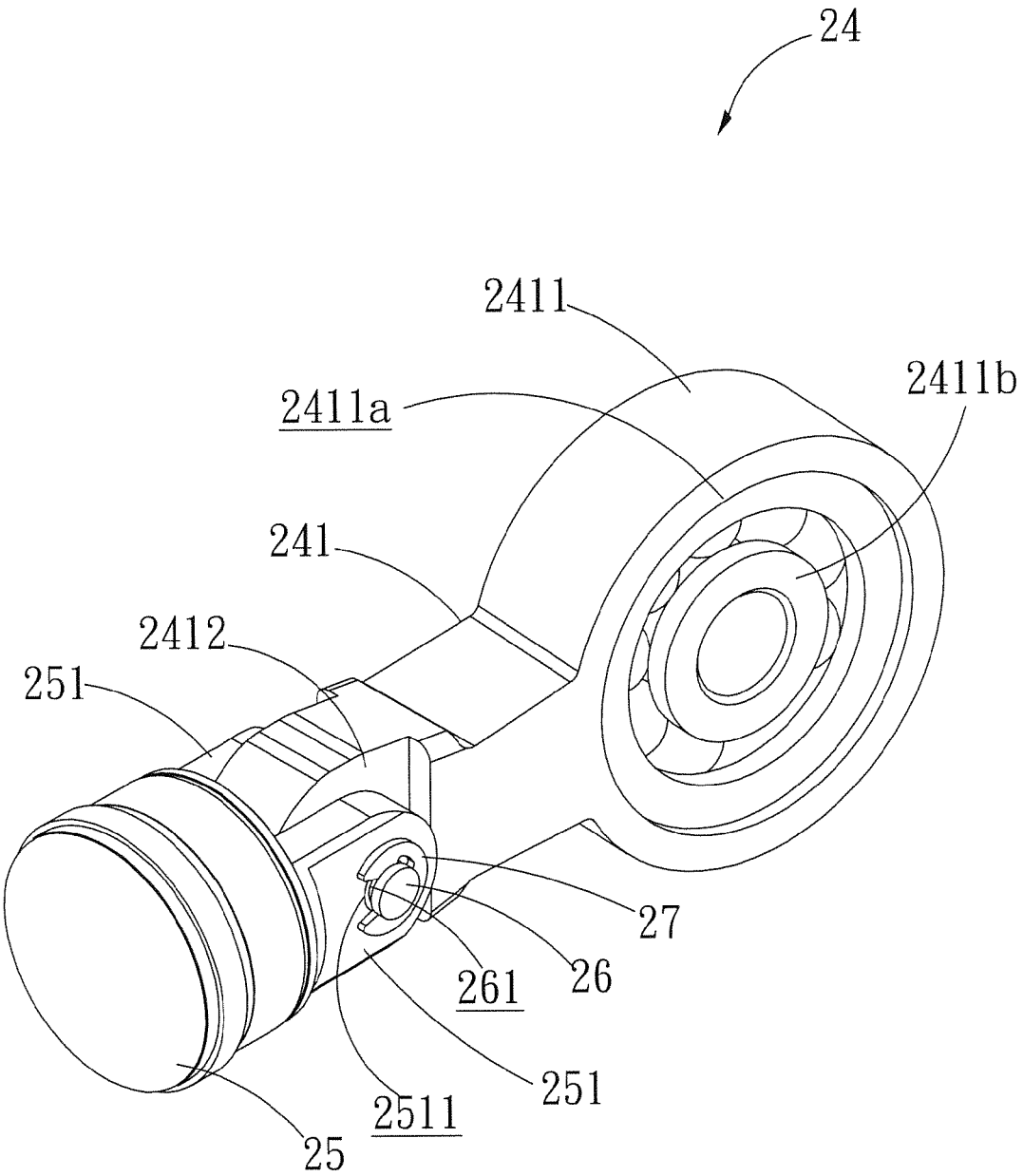
FIG. 3 is a perspective view illustrating a piston/connection rod assembly of the pressure-variable cylinder of the pressure operation control module of the coolant recovery device according to the present invention.
Figure 4:
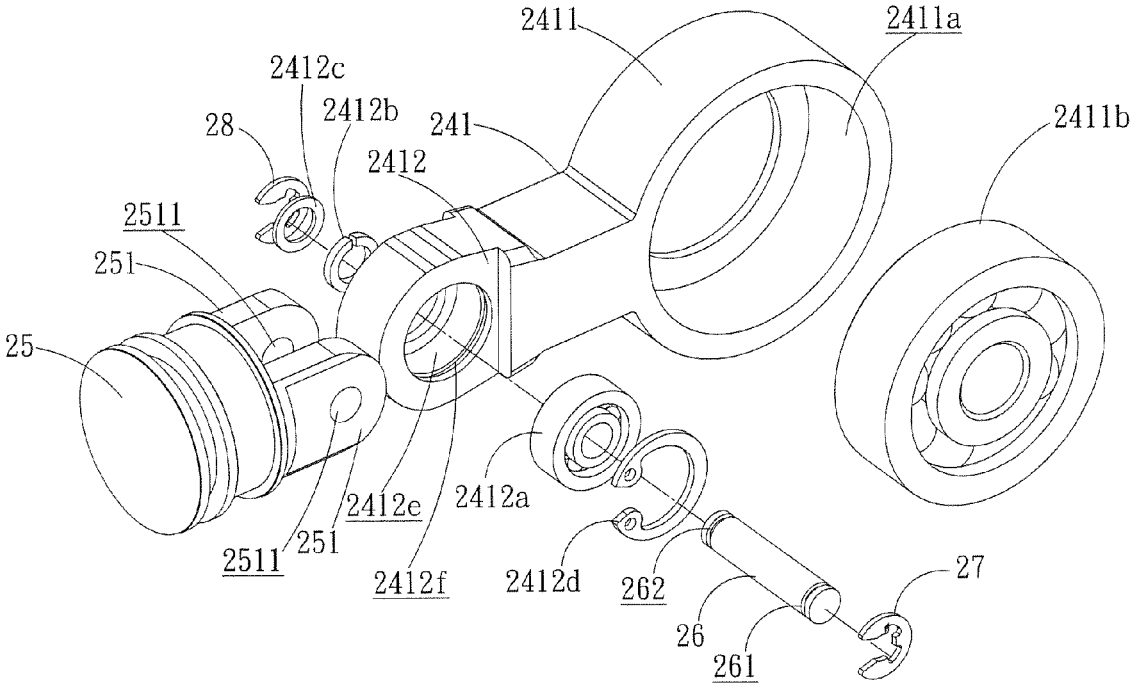
FIG. 4 is exploded view of the piston/connection rod assembly of 之 the pressure-variable cylinder of the pressure operation control module of the coolant recovery device according to the present invention.

Referring to FIGS. 3 and 4, the pressure-variable cylinders 20 each comprise an internal cylinder surface 23 formed therein. The pressure-variable cylinders 20 each comprise a piston/connection rod assembly 24. The piston/connection rod assembly 24 comprises a connection rod 241, a piston head 25, an axle 26, and two axle fastening rings 27, 28. The connection rod 241 has two ends respectively forming at least one connection portion 2411 and a joint portion 2412. The connection portion 2411 comprises a hole 2411*a* formed therein. The hole 2411*a* receives a bearing 2411*b* mounted therein. The joint portion 2412 comprises a bearing 2412*a*, an elastic washer 2412*b*, a washer 2412*c*, and a groove-mounting closure ring 2412*d*. The joint portion 2412 comprises, formed therein, a slot 2412*e* and a circumferential groove 2412*f* formed at one side of the slot 2412*e*. The slot 2412*e* receives the bearing 2412*a*, the elastic washer 2412*b*, the washer 2412*c*, and the groove-mounting closure ring 2412*d* to be sequentially mounted therein with the groove-mounting closure ring 2412*d* fit into the circumferential groove 2412*f* so as to fix the bearing 2412*a*, the elastic washer 2412*b*, and the washer 2412*c* in the slot 2412*e*.

The piston head 25 has an end on which two lugs 251 are mounted. The lugs 251 are each provided with a hole 2511 formed therein. The lugs 251 are respectively set at two opposite sides of the joint portion 2412 of the connection rod 241. The piston head 25 is received in the internal cylinder surface 23 formed in each of the pressure-variable cylinders 20.

The axle 26 has two ends each comprising recessed groove 261, 262 formed therein. The axle 26 extends through and is received in the holes 2511 of the two lugs 251 of the piston head 25 and the bearing 2412*a*, the elastic washer 2412*b*, the washer 2412*c*, and the groove-mounting closure ring 2412*d* of the joint portion 2412 of the connection rod 241.

The two axle fastening rings 27, 28 are respectively fit into and fixed in the recessed grooves 261, 262 of the two ends of the axle 26 to form a pivotal connection structure between the joint portion 2412 of the connection rod 241 and the lugs 251 of the piston head 25 that allows for relative rotation therebetween.

Figure 5:
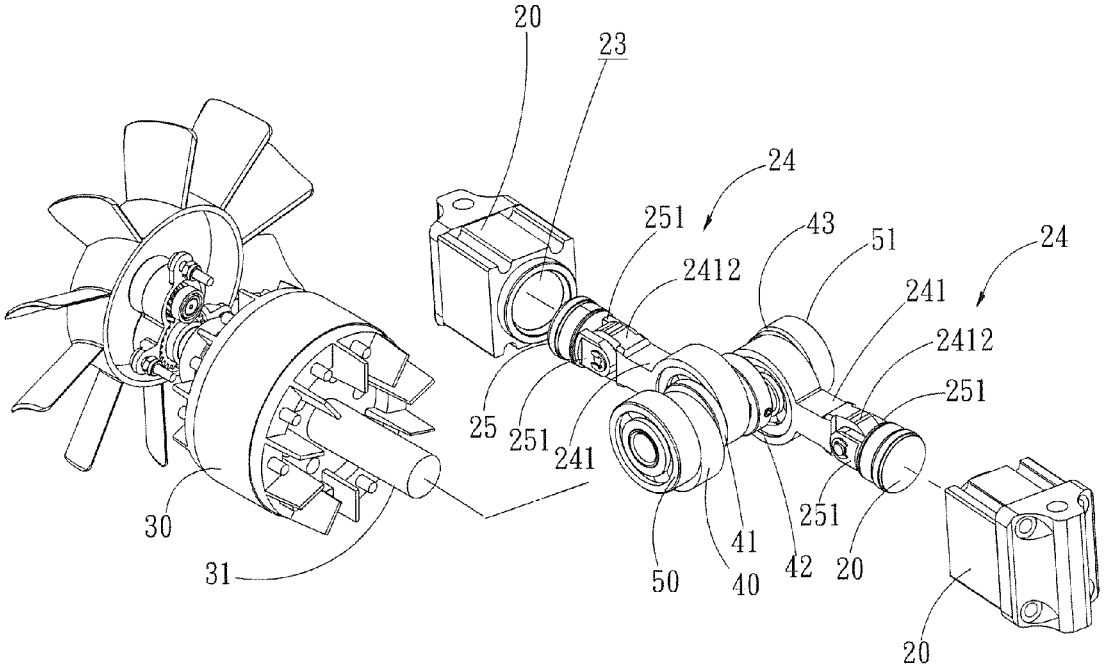
FIG. 5 is a perspective view illustrating the connection between the piston/connection rod assembly of the pressure-variable cylinder of the pressure operation control module of the coolant recovery device according to the present invention and a motor.
Figure 6:
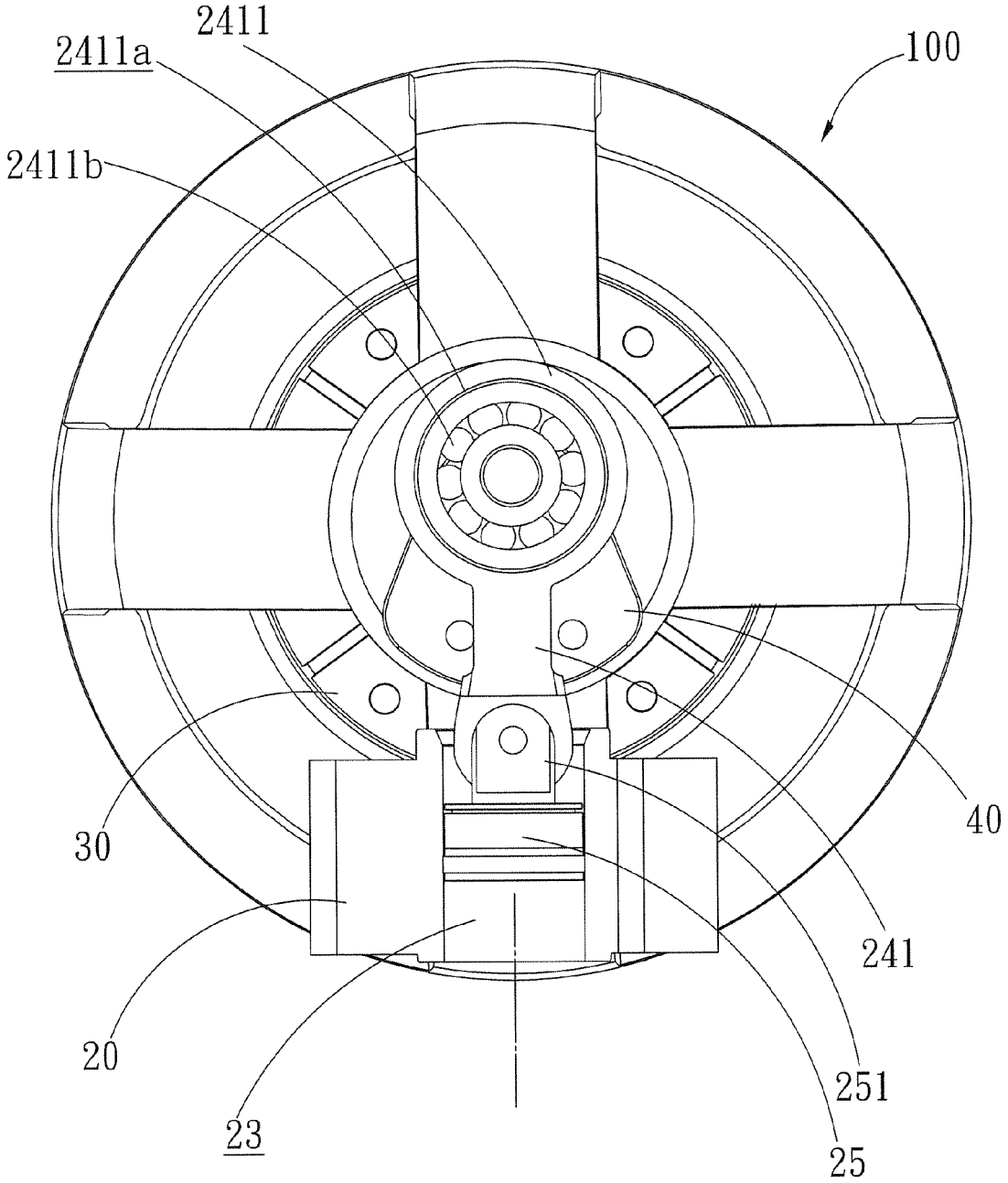
FIG. 6 is a side elevational view, showing a condition of a piston head of the piston/connection rod assembly of the pressure operation control module of the coolant recovery device according to the present invention when a rotation angle of a cam is at a 0-degree position.
Figure 7:
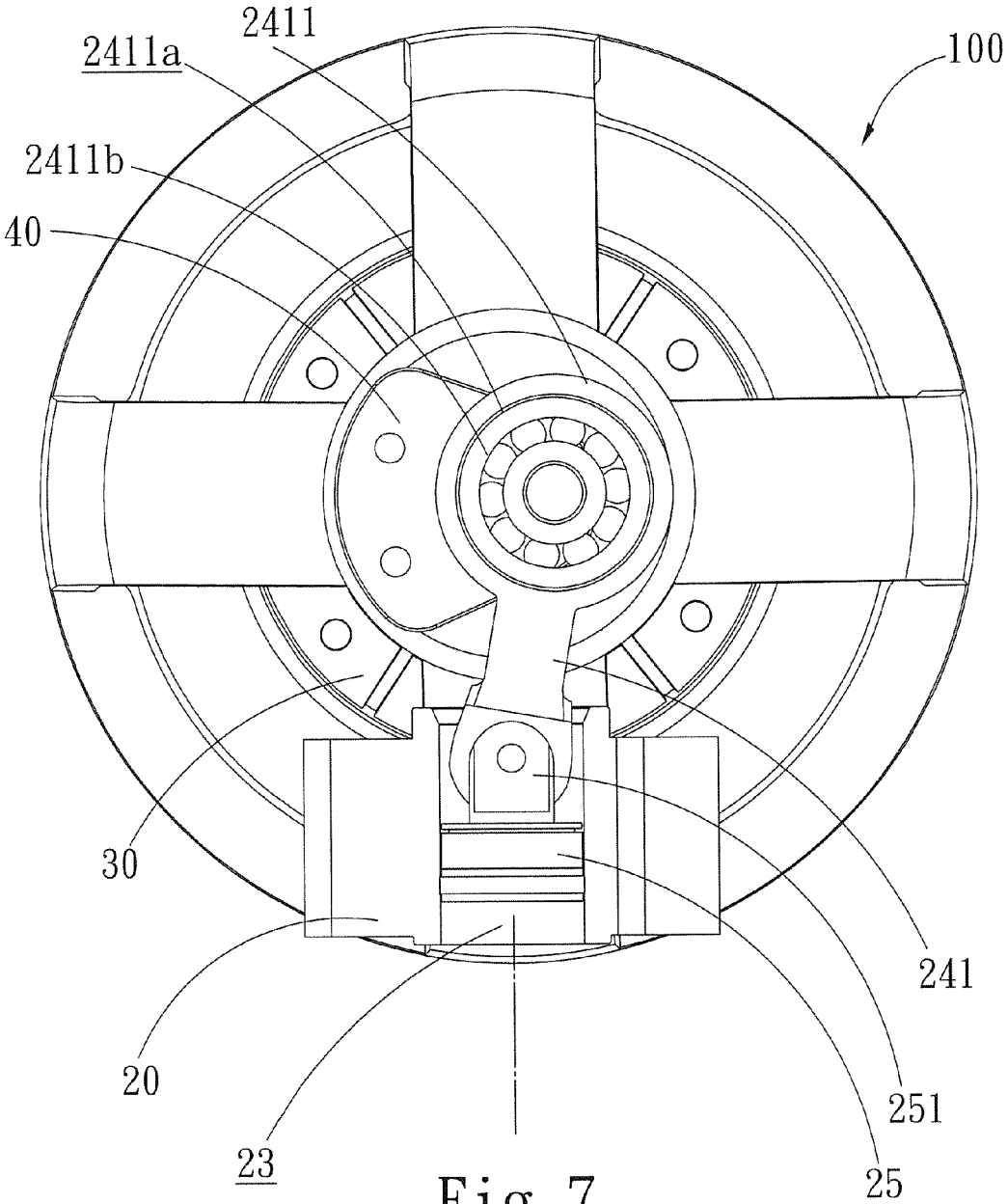
FIG. 7 is a side elevational view, showing a condition of the piston head of the piston/connection rod assembly of the pressure operation control module of the coolant recovery device according to the present invention when the rotation angle of the cam is at a 90-degree position.

Referring to FIGS. 5, 6, and 7, a motor 30 comprises a rotary shaft 31. The rotary shaft 31 is connected to at least one cam 40 and a bearing 50. The cam 40 is further connected, in cascade form, to a plurality of cams 41, 42, 43 and a bearing 51 with the connection portions 2411 of connection rods 241 of the two piston/connection rod assemblies 24 arranged therebetween. In other words, the connection portions 2411 of the connection rods 241 of the two piston/connection rod assemblies 24 are respectively coupled between the cams 41, 42 and the cams 42, 43. The side surface of the cam 43 that is not connected to the connection portion 2411 of the piston/connection rod assembly 24 is connected to the bearing 51. The motor 30 supplies rotating power through the rotary shaft 31 to the cam 40 so that the rotating power is applied through the cams 41, 42 and 43 to drive the connection portions 2411 of the connection rods 241 of the piston/connection rod assemblies 24 to move, whereby the piston heads 25 of the piston/connection rod assemblies 24 that are rotatably connected through the lugs 251 to the joint portions 2412 are driven by the piston heads 25 to move within the internal cylinder surface 23 of the pressure-variable cylinders 20 by each constantly following a straight linear axis. FIGS. 6 and 7 illustrate the relative position of the piston head 25 of the piston/connection rod assembly 24 within the internal cylinder surface 23 of the pressure-variable cylinder 20 respectively for the cam 40 at a rotation angle of 0 degree and 90 degrees, wherein it is clearly shown that the piston head 25 of the piston/connection rod assembly 24 can be constantly maintained on a linear axis in the internal cylinder surface 23 of the pressure-variable cylinder 20 for reciprocal movement in order to ensure that the piston head 25 of the piston/connection rod assembly 24 and the internal cylinder surface 23 of the pressure-variable cylinder 20 are kept in an airtight condition of tight engagement without any leakage therebetween.

Figure 8:
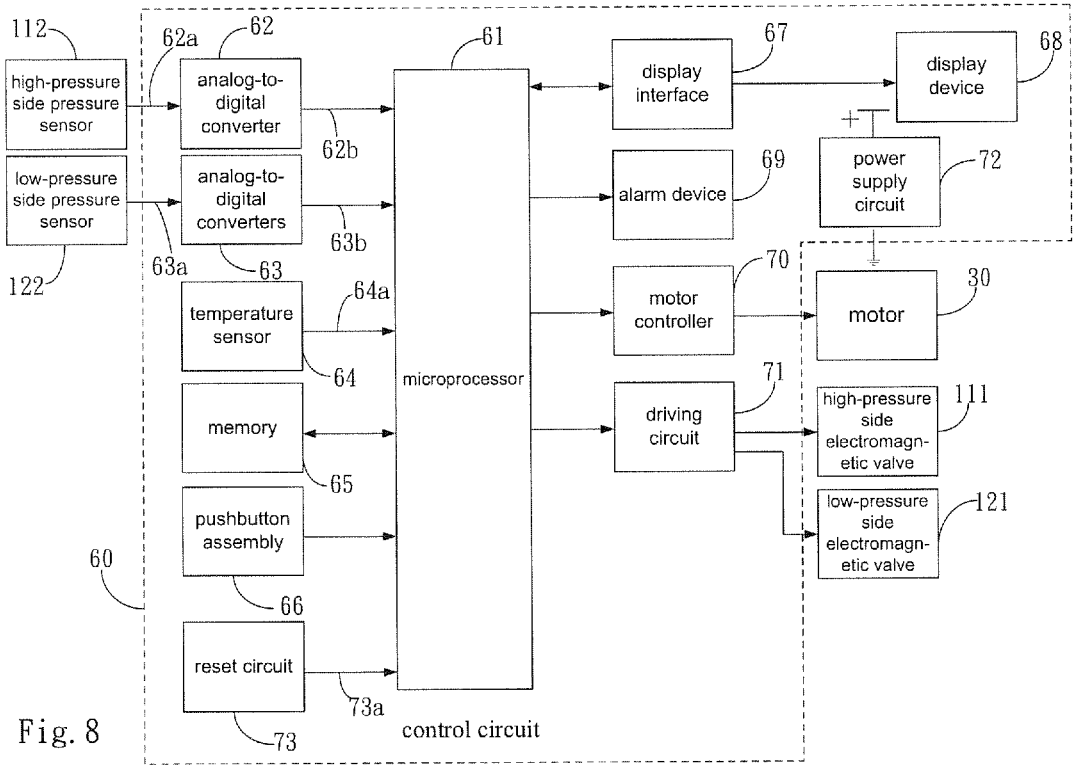
FIG. 8 is a block diagram of a control circuit of the pressure operation control module of the coolant recovery device according to the present invention.

Referring to FIG. 8, a control circuit 60 is electrically connected to the high-pressure side electromagnetic valve 111, the high-pressure side pressure sensor 112, the low-pressure side electromagnetic valve 121, and the low-pressure side pressure sensor 122 of the gas path flow division module 10 in order to control the opening and closing of the high-pressure side electromagnetic valve 111, the low-pressure side electromagnetic valve 121 that are coupled to the gas path flow division module 10 and activation and de-activation of the motor 30 according to the pressure values detected by the high-pressure side pressure sensor 112 and the low-pressure side pressure sensor 122.

The control circuit 60 is not limited to any specific form and an example recited in the present invention comprises a microprocessor 61, two analog-to-digital converters 62, 63, a temperature sensor 64, at least one memory 65, a pushbutton assembly 66, a display interface 67, a display device 68, an alarm device 69, a motor controller 70, a driving circuit 71, and a power supply circuit 72, wherein the microprocessor 61 provides functions of reading of high and low coolant pressures and temperature, displaying, alarming, and outputs of opening/closing control signals for the high-pressure side electromagnetic valve 111 and the low-pressure side electromagnetic valve 121 and activation/de-activation control signals for the motor 30.

The analog-to-digital converters 62, 63 are respectively connected to the high-pressure side pressure sensor 112 and low-pressure side pressure sensor 50 and the microprocessor 61 to convert pressure detection signals 62*a*, 63*a* of the high-pressure side pressure sensor 112 and the low-pressure side pressure sensor 122 into digital data 62*b*, 63 applied to the microprocessor 61. The temperature sensor 64 is electrically connected to the microprocessor 61 to detect the temperature of the coolant flowing in the gas path flow division module 10 and generate a corresponding temperature signal 64*a* to the microprocessor 61. The memory 65 is connected to the microprocessor 61 and stores therein pressure data of various models and types of coolant recovery device 300 and data for the opening/closing time of the high-pressure side electromagnetic valve 111 and the low-pressure side electromagnetic valve 121 and the activation/de-activation control of the motor 30 for coolant recovery operations that are supplied to the microprocessor 61 as a reference for opening/closing the high-pressure side electromagnetic valve 111 and the low-pressure side electromagnetic valve 121 and activation/de-activation of the motor 30.

The pushbutton assembly 66 is electrically connected to the microprocessor 61 for manual operation to set the opening/closing time of the high-pressure side electromagnetic valve 111 and the low-pressure side electromagnetic valve 121 and the control of activation/de-activation of the motor 30 of a coolant recovery operation, displaying and storing operations and control instructions to the microprocessor 61. The display interface 67 and the display device 68 are arranged such that the display interface 67 is connected to the microprocessor 61 and the display device 68 so that the microprocessor 61 may drive the display interface 67 to have the display device 68 display the opening/closing time of the high-pressure side electromagnetic valve 111 and the low-pressure side electromagnetic valve 121 and the control of activation/de-activation of the motor 30 of a coolant recovery operation and status and information regarding setting, displaying, storing, control, or alarm. The display device 68 is not limited to any specific form and a liquid crystal display is taken as an example in the present invention.

The alarm device 69 is connected to the microprocessor 61 and is controlled by the microprocessor 61 to issue an alarm. The alarm device 69 is not limited to any specific form and an audio/video alarm device is taken as an example in the present invention. The motor controller 70 is connected to the microprocessor 61 and the motor 30 so that the microprocessor 61 controls activation or deactivation of the motor 30. The driving circuit 71 is connected to the microprocessor 61, the high-pressure side electromagnetic valve 111, and the low-pressure side electromagnetic valve 121 so as to be driven by the microprocessor 61 to control the opening and closing of the high-pressure side electromagnetic valve 111 and the low-pressure side electromagnetic valve 121. The power supply circuit 72 supplies direct current power to the microprocessor 61, the analog-to-digital converters 62, 63, the temperature sensor 64, the memory 65, the pushbutton assembly 66, the display interface 67, the display device 68, the alarm device 69, the motor controller 70, and the driving circuit 71.

Figure 9:
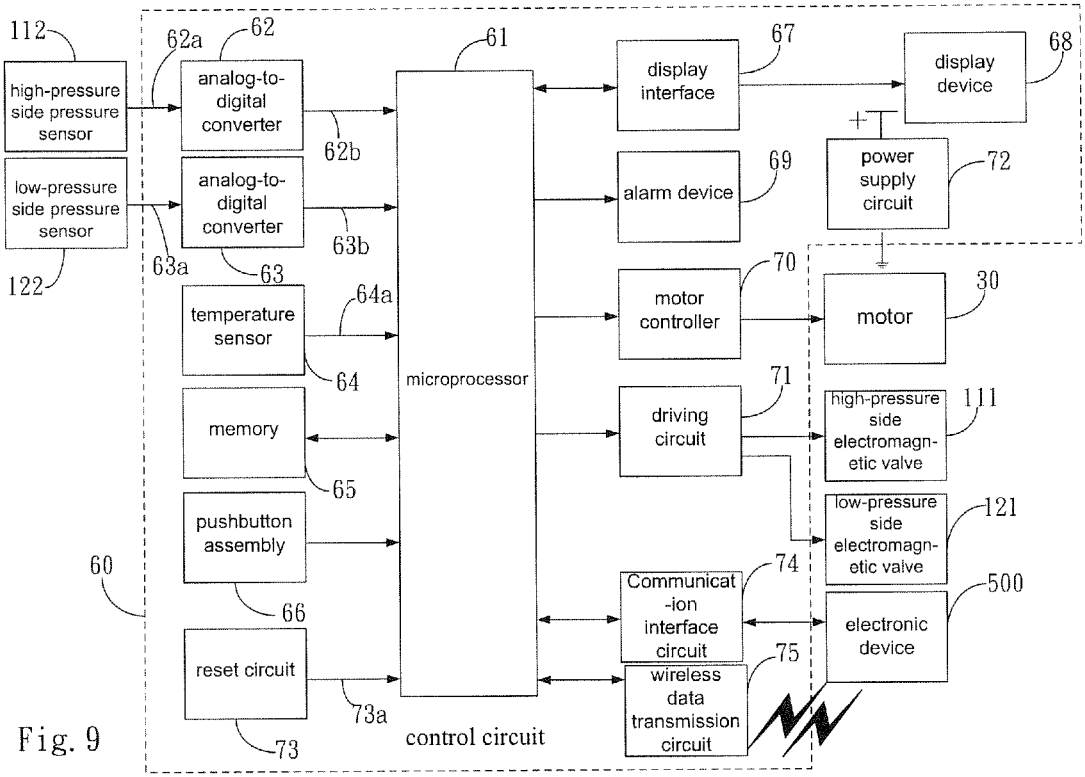
FIG. 9 illustrates another embodiment of the control circuit of the pressure operation control module of the coolant recovery device according to the present invention.

Referring to FIG. 9, another embodiment of the control circuit 60 of the pressure operation control module 100 for a coolant recovery device according to the present invention is shown, in which the microprocessor is connected to a reset circuit 73, a communication interface circuit 74, and a wireless data transmission circuit 75. The reset circuit 73 may generate an alarm reset signal 73*a* to the microprocessor 61 for alarm resetting so as to have the alarm device 69 return to a condition of being not activated. The communication interface circuit 74 is not limited to any specific form and a universal serial bus (USB) interface circuit is taken as an example in the present invention. The communication interface circuit 74 is connected, in a wired manner, to an electronic device 500 to transmit and receive, in a wired manner, pressure data for coolant recovery and data and status of the opening/closing time of the high-pressure side electromagnetic valve 111 and the low-pressure side electromagnetic valve 121 and the control of activation/de-activation of the motor 30 of the coolant recovery operation. The electronic device 500 is not limited to any specific form and an electronic device featuring data communication, such as a computer, a notebook computer, and a smart phone, is taken as an example in the present invention.

The wireless data transmission circuit 75 is not limited to any specific form and a Bluetooth transmission circuit and a wireless USB transmission circuit are taken as examples in the present invention, which receive and transmit, in a wireless manner, pressure data of coolant recovery and the data and status of the opening/closing time of the high-pressure side electromagnetic valve 111 and the low-pressure side electromagnetic valve 121 and the control of activation/de-activation of the motor 30 of the coolant recovery operation.

Figure 11:
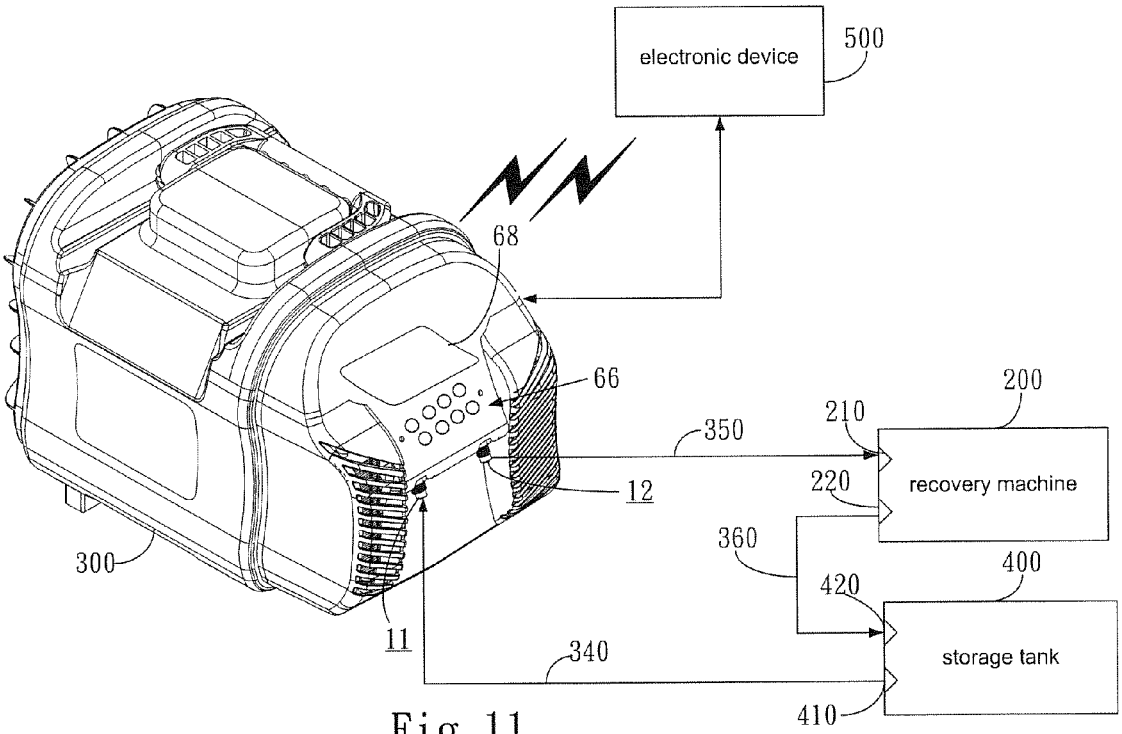
FIG. 11 is a schematic view illustrating an operation of the coolant recovery device of FIG. 10 for recovering coolant.

Referring to FIGS. 10 and 11, an example of the pressure operation control module 100 for a coolant recovery device is provided, wherein a control device 100 is mounted in the coolant recovery device 300 (as shown in FIG. 10), the high-pressure connection terminal 11 and the low-pressure connection terminal 12 of the gas path flow division module 10 are respectively connected, via pipes 340, 350, to a liquid terminal 410 of the storage tank 400 and a gas terminal 210 of the recovery machine 200. A liquid terminal 420 of the storage tank 400 is connected, via a pipe 360, to a liquid terminal 220 of the recovery machine 200 (as shown in FIG. 11). The recovery machine 200 and the storage tank 400 are not limited to any specific forms and an air-conditioner and a gas canister are taken as examples, respectively, in the present invention. Through pressing and operating the pushbutton assembly 66 of the control circuit 60 and displaying provided by the display device 68, the model and type of the recovery machine 200 from which coolant is recovered are selected to allow the control circuit 60 to automatically control the opening and closing time of the high-pressure side electromagnetic valve 111 and the low-pressure side electromagnetic valve 121 and activation and deactivation of the motor 30 of the coolant recovery device 300. In other words, automatic operations of the high-pressure side electromagnetic valve 111 and the low-pressure side electromagnetic valve 121 and the motor 30 is conducted until coolant is completely recovered from the recovery machine 200 and stored in the storage tank 400, when the control circuit 60 automatically closes the high-pressure side electromagnetic valve 111 and the low-pressure side electromagnetic valve 121 and shuts down the motor 30 thereby leaving no residue of coolant and preventing leakage of coolant in the pipes 340, 350, 360 so as to ensure the operation of coolant recovery of the coolant recovery device 300 is conducted in a more accurate manner. After the coolant recovery device 300 completes the recovery of coolant of the recovery machine 200 and the storage tank 400, the alarm device 69 of the control circuit 60 shown in FIGS. 3 and 4 may issues an audio/video alarm to notify an operator and the operator may then operate the pushbutton assembly 66 to reset the alarm device 69.

Further, the pressure operation control module 100 for a coolant recovery device according to the present invention may use the communication interface circuit 74 and the wireless data transmission circuit 75 of the control circuit 60 shown in FIGS. 8 and 9 for receiving, through wired or wireless connection, from an electronic device 500, such as a computer, a notebook computer, and a smart phone, or for receiving between coolant recovery devices 300 having the same control circuits 60, coolant pressure data of various model and types and data and information of the opening/closing time of the high-pressure side electromagnetic valve 111 and the low-pressure side electromagnetic valve 121 and the control of activation/de-activation of the motor 30 of the coolant recovery operation or to transmit coolant pressure data of various model and types and data and information of the opening/closing time of the high-pressure side electromagnetic valve 111 and the low-pressure side electromagnetic valve 121 and the control of activation/de-activation of the motor 30 of the coolant recovery operation to an electronic device 500 or another coolant recovery devices 300 having the same control circuits 60 so that the instantaneous operation information and data of the coolant recovery device 300 can be efficiently transmitted a remote control center or an electronic device 500 or a monitoring operator for monitoring and recording and to allow coolant recovery devices 300 having the same control circuits 60 to share and store data without the need for an operator to re-enter and establish the data and enabling timely update of data and information for control of coolant recovery through wired or wireless transmission.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A pressure operation control module of a coolant recovery device, comprising:

a gas path flow division module, which has a high-pressure connection terminal, a low-pressure connection terminal, and two pairs of output port and input port, the high-pressure connection terminal being connected to the output ports, the low-pressure connection terminal being connected to the input ports in order to provide a function of gas path flow division for collecting coolant from a recovery machine through the coolant recovery device to a storage tank, the coolant high-pressure connection terminal and the coolant low-pressure connection terminal being respectively provided with a high-pressure electromagnetic valve, a low-pressure electromagnetic valve, a high-pressure sensor, and a low-pressure sensor for providing coolant connection control and pressure detection of the high-pressure connection terminal and the low-pressure connection terminal for coolant recovery, the two output ports of the gas path flow division module being respectively connected to input terminals of two heat exchangers arranged in the coolant recovery device;

two pressure-variable cylinders each comprising an input terminal and an output terminal, the output terminals being respectively connected to the two input ports of the gas path flow division module, the input terminals of the pressure-variable cylinders being respectively connected to output terminals of the two heat exchangers to which the gas path flow division module is connected in order to receive coolant from the heat exchangers, the pressure-variable cylinders each comprising a piston/connection rod assembly, the piston/connection rod assembly having an end received in an internal cylinder surface of the pressure-variable cylinder so that a reciprocal movement of the piston/connection rod assembly varies coolant pressure inside the pressure-variable cylinder, which is then supplied through the output terminal of the pressure-variable cylinder to the input port of the gas path flow division module;

a motor, which comprises a rotary shaft coupled to an end of the piston/connection rod assembly of each of the pressure-variable cylinders to drive the piston/connection rod assembly to do linear reciprocal movement in the pressure-variable cylinder; and at least one control circuit that is electrically connected to the high-pressure side electromagnetic valve, the low-pressure side electromagnetic valve, the high-pressure side pressure sensor, and the low-pressure side pressure sensor of the gas path flow division module in order to control the opening and closing of the high-pressure side electromagnetic valve, the low-pressure side electromagnetic valve that are coupled to the gas path flow division module and activation and de-activation of the motor according to the pressure values detected by the high-pressure side pressure sensor and the low-pressure side pressure sensor.

2. The pressure operation control module of the coolant recovery device as claimed in claim 1, wherein the high-pressure side electromagnetic valve and the low-pressure side electromagnetic valve of the gas path flow division module are anti-explosion electromagnetic valves.

3. The pressure operation control module of the coolant recovery device as claimed in claim 1, wherein the piston/connection rod assembly of each of the pressure-variable cylinders comprises:

a connection rod, which has two ends respectively forming at least one connection portion and a joint portion, the connection portion being connected between a plurality of cams connected in a cascade form and a bearing, one of the cams being connected to the rotary shaft of the motor to provide rotating power to the connection portion of the connection rod, the joint portion comprising a bearing, an elastic washer, a washer, and a groove-mounting closure ring;

a piston head, which has an end on which two lugs are mounted, the lugs being respectively set at two opposite sides of the joint portion of the connection rod;

an axle, which extends through the two lugs of the piston head and the bearing, the elastic washer, the washer, and the groove-mounting closure ring of the joint portion of the connection rod; and two axle fastening rings, which are respectively fixed to two ends of the axle to form a pivotal connection structure between the joint portion of the connection rod and the lugs of the piston head that allows for relative rotation therebetween so that when the piston head is disposed in and moves in the pressure-variable cylinder, a linear motion is achieved that keeps a gap-free tight engagement with an inside surface of the pressure-variable cylinder.

4. The pressure operation control module of the coolant recovery device as claimed in claim 3, wherein the connection portion of the connection rod of the piston/connection rod assembly of each of the pressure-variable cylinders comprises a hole formed therein, the hole receiving a bearing mounted therein.

5. The pressure operation control module of the coolant recovery device as claimed in claim 3, wherein the joint portion of the connection rod of the piston/connection rod assembly of each of the pressure-variable cylinders comprises a slot formed therein for receiving the bearing, the elastic washer, the washer, and the groove-mounting closure ring mounted therein.

6. The pressure operation control module of the coolant recovery device as claimed in claim 3, wherein the joint portion of the connection rod of the piston/connection rod assembly of each of the pressure-variable cylinders comprises a circumferential groove formed at one side of the slot to the groove-mounting closure ring fit therein.

7. The pressure operation control module of the coolant recovery device as claimed in claim 3, wherein the lugs of the piston head of the piston/connection rod assembly of the pressure-variable cylinders are each provided with a hole formed therein for extension of the axle.

8. The pressure operation control module of the coolant recovery device as claimed in claim 3, wherein the axle of the piston/connection rod assembly of the pressure-variable cylinders has two ends forming recessed grooves for receiving the axle fastening rings to fit therein.

9. The pressure operation control module of the coolant recovery device as claimed in claim 3, wherein the axle fastening rings of the piston/connection rod assembly of the pressure-variable cylinders are C-clips.

10. The pressure operation control module of the coolant recovery device as claimed in claim 1, wherein the control circuit comprises:

a microprocessor, which provides functions of reading of high and low coolant pressures and temperature, displaying, alarming, and outputs of opening/closing control signals for the high-pressure side electromagnetic valve and the low-pressure side electromagnetic valve and activation/de-activation control signals for the motor;

two analog-to-digital converters, which are respectively and electrically connected to the high-pressure side pressure sensor and the low-pressure side pressure sensor of the gas path flow division module and the microprocessor to convert pressure detection signals of the high-pressure side pressure sensor and the low-pressure side pressure sensor into digital data applied to the microprocessor;

a temperature sensor, which is electrically connected to the microprocessor to detect the temperature of the coolant flowing in the gas path flow division module and generate a corresponding temperature signal to the microprocessor;

at least one memory, which is connected to the microprocessor and stores therein pressure data of various models and types of coolant recovery device and data for the opening/closing time of the high-pressure side electromagnetic valve and the low-pressure side electromagnetic valve of the gas path flow division module and the activation/de-activation control of the motor for coolant recovery operations that are supplied to the microprocessor as a reference for opening/closing the high-pressure side electromagnetic valve and the low-pressure side electromagnetic valve and activation/de-activation of the motor;

a pushbutton assembly, which is electrically connected to the microprocessor for manual operation to set the opening/closing time of the high-pressure side electromagnetic valve and the low-pressure side electromagnetic valve of the gas path flow division module and the control of activation/de-activation of the motor of a coolant recovery operation, displaying and storing operations and control instructions to the microprocessor;

a display interface and a display device, the display interface being connected to the microprocessor and the display device so that the microprocessor drives the display interface to have the display device display the opening/closing time of the high-pressure side electromagnetic valve and the low-pressure side electromagnetic valve of the gas path flow division module and the control of activation/de-activation of the motor of the coolant recovery operation and status and information regarding setting, displaying, storing, control, or alarm;

an alarm device, which is connected to the microprocessor to be controlled by the microprocessor to issue an alarm;

a motor controller, which is connected to the microprocessor and the motor so that the microprocessor controls activation or deactivation of the motor;

a driving circuit, which is connected to the microprocessor and the high-pressure side electromagnetic valve and the low-pressure side electromagnetic valve of the gas path flow division module so as to be driven by the microprocessor to control the opening and closing of the high-pressure side electromagnetic valve and the low-pressure side electromagnetic valve; and a power supply circuit, which supplies direct current power to the microprocessor, the analog-to-digital converters, the temperature sensor, the memory, the push-button assembly, the display interface, the display device, the alarm device, the motor controller, and the driving circuit.

11. The pressure operation control module of the coolant recovery device as claimed in claim 10, wherein the microprocessor is connected to a reset circuit to generate an alarm reset signal to the microprocessor for alarm resetting so as to have the alarm device return to a condition of being not activated.

12. The pressure operation control module of the coolant recovery device as claimed in claim 10, wherein the microprocessor is connected to a communication interface circuit, the communication interface circuit being connected to an electronic device to transmit and receive, in a wired manner, pressure data for coolant recovery and data and status of the opening/closing time of the high-pressure side electromagnetic valve and the low-pressure side electromagnetic valve and the control of activation/de-activation of the motor to transmit and receive, in a wired manner, pressure data for coolant recovery and data and status of the opening/closing time of the high-pressure side electromagnetic valve and the low-pressure side electromagnetic valve and the control of activation/de-activation of the motor of the coolant recovery operation of the coolant recovery operation.

13. The pressure operation control module of the coolant recovery device as claimed in claim 12, wherein the communication interface circuit to which the microprocessor is connected comprises a universal serial bus (USB) interface circuit.

14. The pressure operation control module of the coolant recovery device as claimed in claim 10, wherein the microprocessor is connected to a wireless data transmission circuit to receive or transmit, in a wireless manner, pressure data for coolant recovery and data and status of the opening/closing time of the high-pressure side electromagnetic valve and the low-pressure side electromagnetic valve and the control of activation/de-activation of the motor of the coolant recovery operation of the coolant recovery operation.

15. The pressure operation control module of the coolant recovery device as claimed in claim 14, wherein the wireless data transmission circuit to which the microprocessor is connected comprises a Bluetooth transmission circuit.

16. The pressure operation control module of the coolant recovery device as claimed in claim 14, wherein the wireless data transmission circuit to which the microprocessor is connected comprises a wireless USB transmission circuit.

17. The pressure operation control module of the coolant recovery device as claimed in claim 10, wherein the display device comprises a liquid crystal display device.

18. The pressure operation control module of the coolant recovery device as claimed in claim 10, wherein the alarm device comprises an audio/video alarm device.

* * * * *